United States Patent [19]

Stancato

[11] Patent Number: 4,623,038

[45] Date of Patent: Nov. 18, 1986

[54] PORTABLE ESCAPE DEVICE

[76] Inventor: Enzo Stancato, 33 Windy Knolls, Greenwich, Conn. 06830

[21] Appl. No.: 741,528

[22] Filed: Jun. 4, 1985

[51] Int. Cl.[4] ..... A62B 1/10

[52] U.S. Cl. ..... 182/239; 182/240; 182/234; 182/72

[58] Field of Search ..... 182/231–240, 182/71–73; 162/5–7, 191–193; 188/65.1–65.5, 71.2; 192/95, 89 A, 99.5

[56] References Cited

U.S. PATENT DOCUMENTS

| | | | |
|---|---|---|---|
| 2,702,106 | 2/1955 | Strahota | 188/71.2 |
| 2,761,650 | 9/1956 | Faugier | 182/239 |
| 2,922,624 | 1/1960 | Addicks | 192/89 A |
| 3,050,744 | 9/1964 | Fertier | 182/239 |
| 3,850,262 | 11/1974 | Simizu | 182/72 |
| 3,889,777 | 1/1975 | George | 182/193 |
| 3,934,688 | 1/1976 | Sides | 192/89 A |
| 4,487,292 | 12/1984 | Smith | 182/234 |
| 4,489,919 | 12/1984 | Ostrobrod | 182/234 |

FOREIGN PATENT DOCUMENTS

| | | | |
|---|---|---|---|
| 87650 | 9/1983 | European Pat. Off. | 182/231 |

*Primary Examiner*—Reinaldo P. Machado
*Assistant Examiner*—A. Chin-Shue

[57] ABSTRACT

The present invention is directed to a new and improved design associated with the fabrication and construction of a portable escape device wherein a cable is wound around a drum physically encased therein, said drum being mechanically interrelated with two separate and distinct brake mechanisms through a series of interrelated gears, the brake mechanisms capable of being automatically and/or manually actuated independent of each other or in combination therewith so as to control the rate of movement of said drum and thus regulate the rate of release of said cable wound around said drum. Furthermore, one of the brake mechanisms is air cooled and operates upon centrifugal force principals to achieve braking.

8 Claims, 8 Drawing Figures

PORTABLE ESCAPE DEVICE

BACKGROUND AND OBJECTS OF THE INVENTION

The present invention relates to a generally new and improved design associated with the fabrication and construction of a portable escape device capable of providing a means of escape and/or descent from any building or other tall structure in the event of an emergency threatening the safety of occupants thereof, such as a fire.

In conjunction therewith and prior to the present invention, escape devices were known, but not of a design nor method of construction which lended themselves to the advantages and overall efficiencies achievable in conjunction with the present invention.

More particularly, although it was known in the prior art to construct an escape device as disclosed and claimed in U.S. Pat. No. 324,670 issued on Aug. 18, 1885, to W. B. Doolittle of Chicago, Ill.; U.S. Pat. No. 388,491 issued on Aug. 28, 1888, to L. Hill of Muncy, Pa.; U.S. Pat. No. 636,480 issued on Nov. 7, 1899, to W. O. Abbott of Kittanning, Pa.; U.S. Pat. No. 660,792 issued on Oct. 30, 1900, to E. S. Gail of Highland Park, Ill.; U.S. Pat. No. 820,241 issued on May 8, 1906, to D. M. McCathie and W. R. & N. B. Cain of Port Jervis, N.Y.; U.S. Pat. No. 849,221 issued on Apr. 2, 1907, to F. G. Engel of Manhattan, N.Y.; U.S. Pat. No. 866,516 issued on Sept. 17, 1907, to W. B. Purdy of Corsica, Pa.; U.S. Pat. No. 2,680,593 issued on June 8, 1954, to W. D. McIntyre of Monroe, Mich.; U.S. Pat. No. 3,834,671 issued on Sept. 10, 1974, to Godefroy L. M. Du Mesnil du Buisson of Versailles, France; U.S. Pat. No. 4,416,351 issued on Nov. 22, 1983, to Alfonsus A. Geurtsen of Deventer, Netherlands; and U.S. Pat. No. 4,437,546 issued on Mar. 20, 1984, to Gerald P. Marinoff and W. Dorwin Teague of Nyack, N.Y., same being representative of the state of the prior art to date, said prior art neither teaches nor discloses the present invention which improves upon the many disadvantages associated therewith.

More particularly, the present invention directs itself to a new and improved design for a portable escape device which incorporates and otherwise overcomes many disadvantages associated with prior art devices, said device incorporating within its design and function many features which enable said device to accomplish various objects of the invention as hereinafter set forth.

It is in the context of the above that one of the primary objectives of the invention is to create a new and improved portable escape device that is capable of either being physically affixed to a building structure and having the cable that is fed therefrom during its utilization physically attach to the individual seeking to be lowered, or in the alternative, the escape device itself can be directly fastened to the individual being lowered and the cable fed therefrom being fastened to a stationary object within the structure in question thus affording the individual descending in conjunction with said portable escape device direct access thereto so as to adjust the rate of discent afforded by said portable escape device.

It is another object of this invention to create a new and improved design associated with the fabrication and construction of a portable escape device wherein there is provided a portable escape device that is air cooled during its operation so as to avoid overheating and thus malfunctioning of the device.

It is another object of this invention to create a new and improved design associated with the fabrication and construction of a portable escape device wherein the portable escape device is capable of lowering an individual to a particular predetermined level and which is otherwise controlled by the party operating said device.

It is another object of this invention to create a new and improved design associated with the fabrication and construction of a portable escape device wherein said cable associated with said device is capable of either being manually rewound or rewound by automatic mechanical means.

It is another object of this invention to create a new and improved design associated with the fabrication and construction of a portable escape device wherein the braking mechanism associated with the portable escape device is capable of selective adjustment.

It is another object of this invention to create a new and improved design associated with the fabrication and construction of a portable escape device wherein said portable escape device permits an operator to manually raise himself upwards from a particular position or location while operating said portable escape device in addition to being able to selectively lower oneself.

It is another object of this invention to create a new and improved design associated with the fabrication and construction of a portable escape device wherein the braking mechanism utilized in conjunction with the operation of said portable escape device in addition to operating in accordance with preset parameters, can also be manually adjusted during operation of said device.

It is another object of this invention to create a new and improved design associated with the fabrication and construction of a portable escape device wherein the braking mechanism of said portable escape device can be engaged in accordance with the principles of centrifugal force in a predetermined manner so as to provide controlled descent of an individual utilizing said portable escape device.

It is another objection of this invention to create a new and improved design associated with the fabrication and construction of a portable escape device wherein two separate and distinct but interrelated braking means are utilized in conjunction with the invention, one of same being air cooled by utilization of an air cooling chamber.

The objects and advantages of the invention are set forth in part herein and in part will be obvious herefrom or may be learned by the practice of the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

Briefly described, the present invention is directed to a new and improved design associated with the fabrication and construction of a portable escape device wherein a cable is wound around a drum physically encased within said device, said drum being mechanically interrelated with two separate and distinct brake mechanisms through a series of interrelated gears, said brake mechanisms capable of being automatically and/or manually actuated so as to control the rate of movement of said drum and thus regulating the rate of release of said cable wound around said drum.

Additionally, one of the brake mechanisms is air cooled and capable of being selectively engaged so as to thereby selectively modify the effect of said braking effect upon the rate of release of said cable.

Additionally, said portable escape device is capable of operation such that the release of cable can be stopped and started at the discretion of its operator and the rewinding of said cable upon said drum within said device can either be accomplished through manual rotation of said drum by an operator thereof, through a mechanical spring loaded arrangement that results in the rewinding of said cable automatically, or by other electro-mechanical rewind means.

It will be understood that the foregoing general description and the following detailed description as well are exemplary and explanatory of the invention, but are not restrictive thereof.

The accompanying drawings referred to herein and constituting a part hereof, are illustrative of the invention but not restrictive thereof, and, together with the description, serve to explain the principles of the invention.

DESCRIPTION OF A PREFERRED EMBODIMENT

Figure 1:
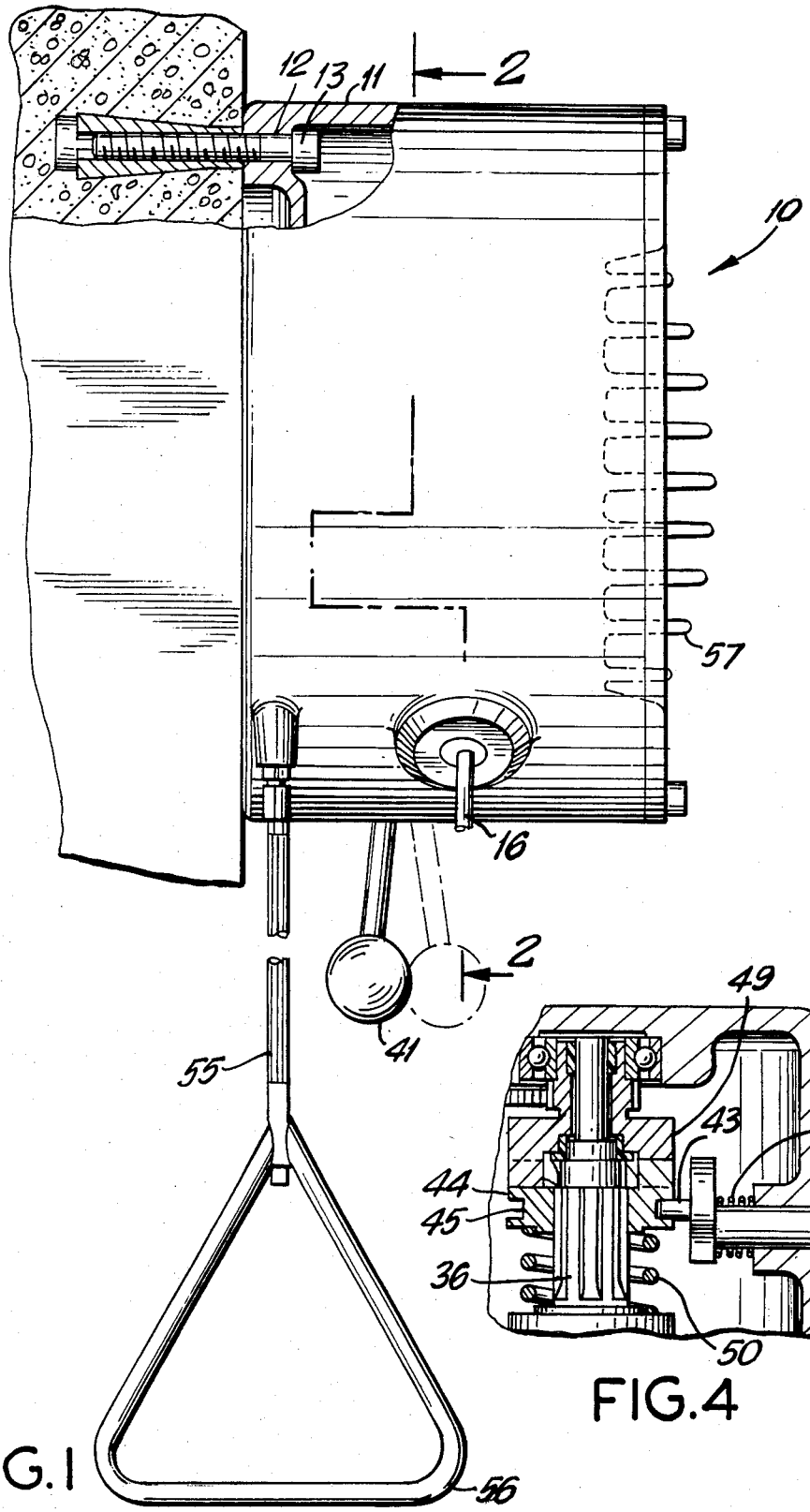
FIG. 1 is a front elevational view of a portable escape device constructed in accordance with the invention evidencing a partial sectional view thereof depicting said portable escape device affixed to a solid structure.

Referring now more particularly to the embodiment of the above invention illustrated in the accompanying drawings, there is illustrated in FIG. 1 a portable escape device constructed in accordance with the instant invention and indicated generally by reference numeral 10.

Figure 2:
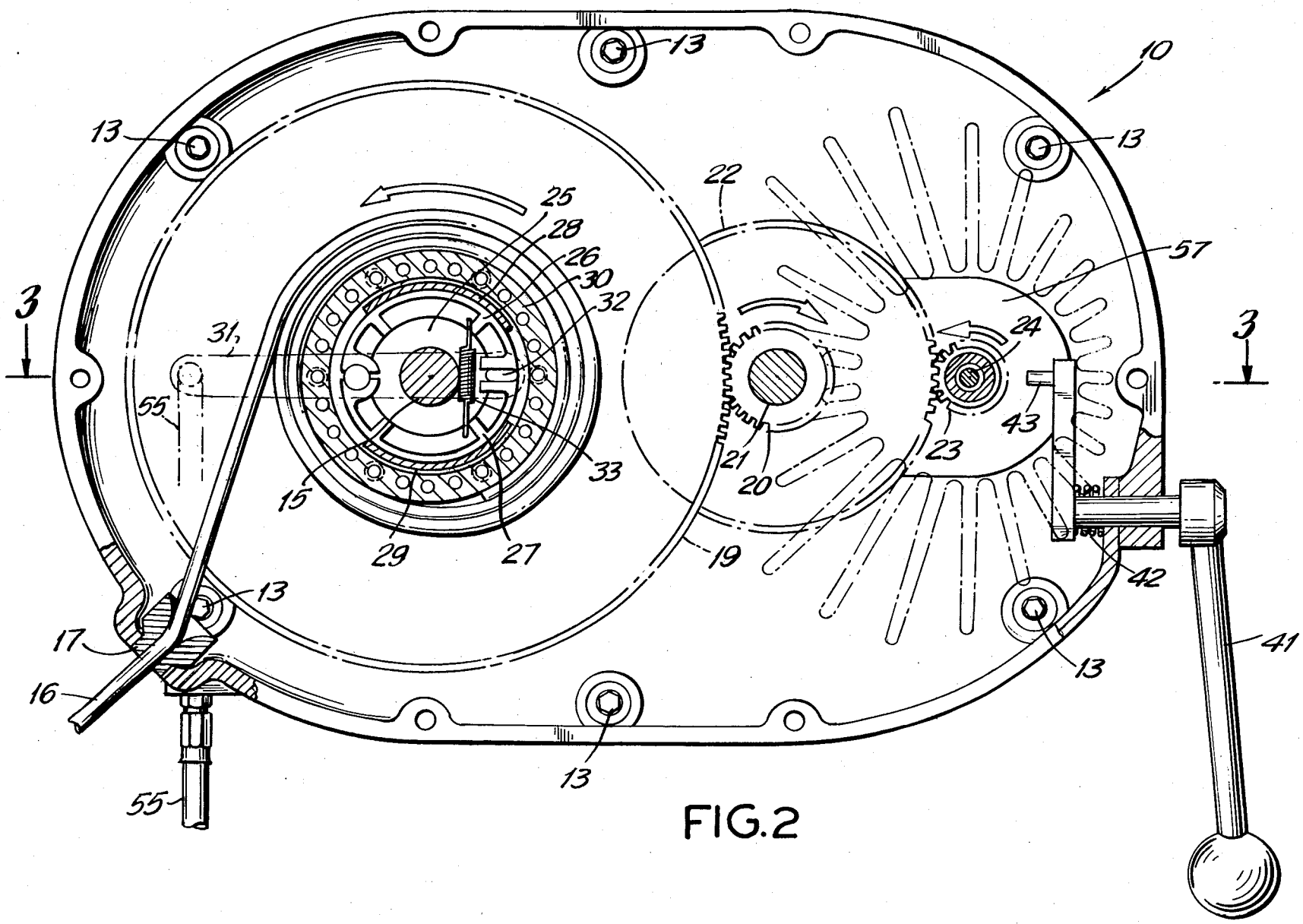
FIG. 2 is a cross sectional view of the portable escape device as illustrated in FIG. 1 and taken along lines 2—2.
Figure 3:
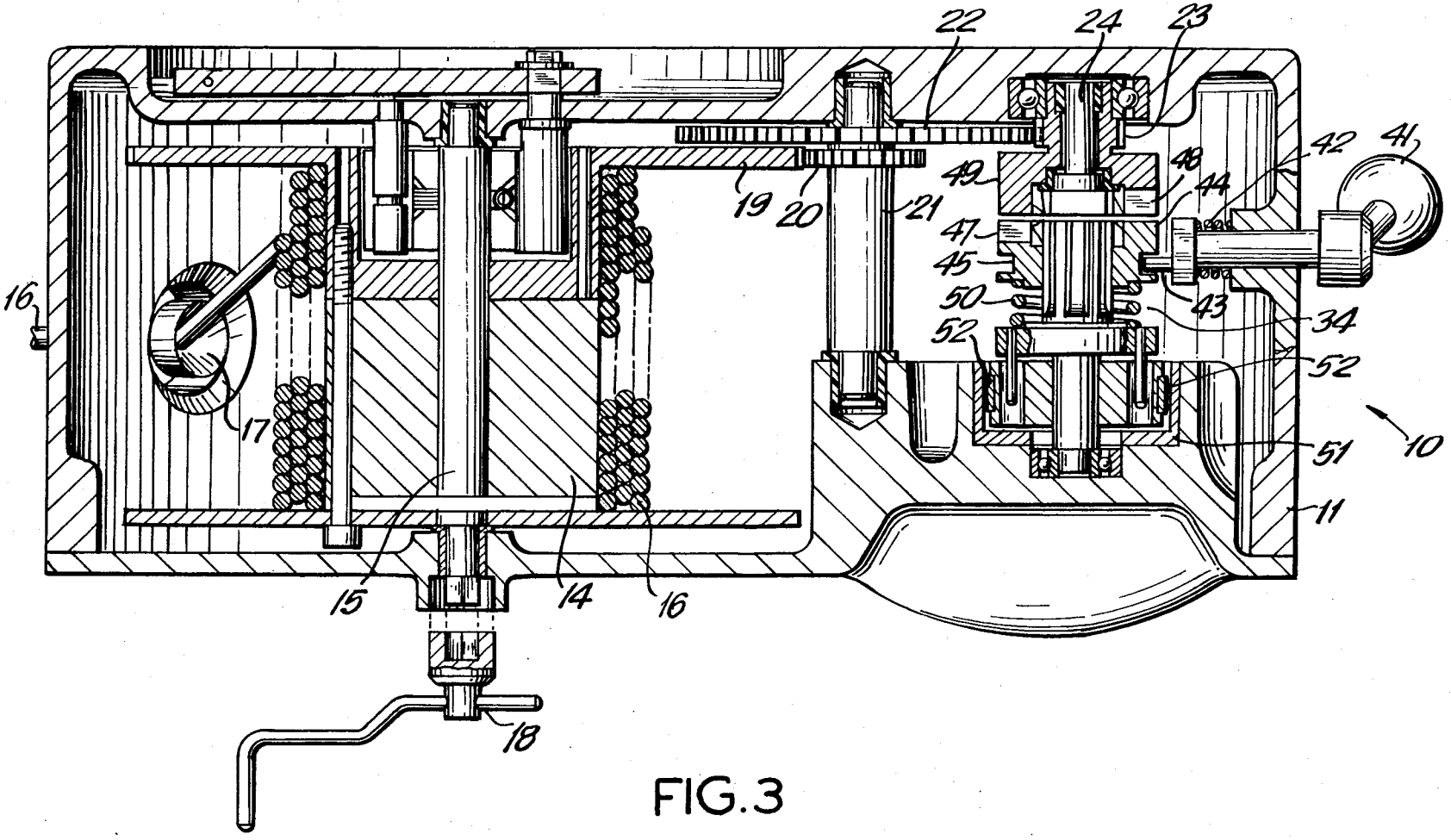
FIG. 3 is a cross-sectional view taken along lines 3—3 of FIG. 2 depicting the brake mechanisms utilized in a preferred embodiment of the invention.

In accordance with the invention and as illustrated in FIG. 1, FIG. 2 and FIG. 3 of the drawings, portable escape device 10 comprises a housing 11 that has formed therein a cavity capable of containing the remaining elements of the device as more specifically set forth hereinafter.

In conjunction with housing 11, it should be noted that same can be fabricated from any one of a number of desired materials, such as aluminum, alloys of aluminum, stainless steel and the like, the characteristics of said material utilized and fabricated in said housing are such as to be lightweight in nature but capable of providing structural integrity to the overall device, it being specifically understood that the reference to aluminum, alloys of aluminum, stainless steel and the like, as hereinabove set forth are illustrative of possible materials to be utilized for the forming of housing 11, but are not to be considered limiting thereof.

Additionally, as part of housing 11, there is formed symmetrically about the external portion of the back face thereof, openings 12, each capable of having a fastening means 13 utilized to either affix housing 11 of portable escape device 10 to a permanent structure such as a wall, floor or the like as depicted in FIG. 1, or in the alternative, to utilize openings 12 as a means through which is passed a rope so as to be able to fasten said portable escape device 10 to a safety harness capable of being worn upon the body of an individual similarly as is done with a parachute.

Thus, there is achieved the ability to either utilize portable escape device 10 as a stationary housing affixed to a structure from which a person seeks to descend by permanently affixing same thereto with the use of fastening means 13 or to have portable escape device 10 affixed to the body of an individual seeking to use same as a means to escape from a particular location and fastening the end of cable 16 contained in said device to a portion of the structure in question, the flexibility of use with regard to the above being inherent in the overall design.

As set forth in FIG. 3, there is mounted within housing 11 of portable escape device 10 a drum 14 that is rotationally mounted about axle 15 and having wound thereon cable 16.

In accordance with the invention, cable 16 is of a sufficient length and the size of drum 14 is such so as to contain thereon a sufficient amount of cable capable of providing an amount of cable in excess of that required to descend from a particular point or location in accordance with the particular characteristics of the specific utilization of portable escape device 10.

As indicated in FIG. 3, cable 16 is fed out of housing 11 from drum 14 through channel member 17, said channel member being of a material such as brass, bronze, polyurethane or the like which avoids any undue friction and/or wear upon cable 16 as it is wound and unwound with regard to drum 14. Additionally, it should be understood that the reference to fabricating channel member 17 from such materials as brass, bronze, polyurethane, or the like, is only illustrative of possible materials capable of such utilization, but the citing thereof should not be considered to be limiting thereof.

Additionally, it should be noted that cable 16 can be fabricated from any of a number of well known prior art materials such as steel, nylon, or Kavalar as manufactured by Dupont, it being understood that the particular mention of said materials should not be considered as limiting of the invention, but rather, only illustrative thereof, it being desirable to have cable 16 have the characteristics of being lightweight, strong and resistant.

There is further illustrated in FIG. 3, crank mechanism 18 which provides a mechanical structure well known within the prior art whereby there is provided the ability to manually turn drum 14 about its axle 15 within housing 11 so as to either wind or unwind cable 16 about drum 14, it being within the scope of the present invention to have crank mechanism 18 detachable from its interfit with housing 11 and axle 15 as illustrated in FIG. 3. Additionally, an electro-mechanical mechanism can also interfit with axle 15 in a fashion similar to crank mechanism 18 as is well known in the prior art so as to provide a means for automatic rotational rewinding.

In further keeping with the invention, axle 15 of drum 14 has axially affixed thereto gear member 19 which axially rotates about axle 15 upon the rotational movement of drum 14. Furthermore, gear member 19 is structurally meshed with gear member 20 which is axially affixed about its own axle 21, axle 21 being structurally mounted within the walls of housing 11.

Additionally, gear member 22 is also structurally affixed to axle 21 and upon rotational movement of axle 21 gear member 22 thus rotates. Gear member 23 is structurally meshed with gear member 22, gear member 23 being axially affixed about its own axle 24, axle 24 being structurally mounted within the walls of housing 11.

In keeping with the invention, it should be understood that gear members 19, 20, 22 and 23 as well as axles 15, 21 and 24 can be fabricated and otherwise constructed from any one of a number of known prior art materials utilized for such construction within the prior art, keeping in mind that it is in keeping with the invention and the preferred embodiment referred to herein that said gears and axles are to be fabricated from materials that are light in weight, and with structural integrity sufficient to withstand the stresses and loads to which portable escape device 10 will be exposed during its utilization.

As depicted in FIG. 2, drum 14 and axle 15 are mechanically interrelated as is well known within the prior art with brake mechanism 25. More particularly, and as depicted in FIG. 2, axle 15 is structurally affixed to rotational plate members 26 and 27, rotational plate members 26 and 27 having affixed thereto brake shoe members 28 and 29 respectively, said rotational plate members 26 and 27 and brake shoe members 28 and 29 being contained within brake housing 30 such that upon rotational movement of axle 15, rotational plate members 26 and 27 rotationally spin about axle 15 within brake housing 30 and as is well known within the prior art, as said rotational movement is sought to be controlled. To achieve braking of the rotational movement of drum 14 about its axle 15 by brake mechanism 25, rotational plate members 26 and 27, with their respective brake shoe members 28 and 29 respectively are caused to be physically pressed against the wall of brake housing 30 due to the fact that the mechanical movement of lever 31 causes cam 32 to move about its axis, which, due to its oblong cross section, causes rotational plate members 26 and 27 to be forced outward from axle 15. Thus by way of the friction created as a result of the contact between brake shoe members 28 and 29 with brake housing 30, the rotational movement of axle 15 and drum 14 is selectively controlled.

Additionally, by utilization of compressed spring mechanism 33, brake shoe members 28 and 29 are normally maintained in a mechanical position not in contact with brake housing 30, frictional contact for braking purposes not occurring until lever 31 is manually actuated.

In keeping with the invention, there is additionally utilized in conjunction with brake mechanism 25, a second brake mechanism, this second brake mechanism being more generally referred to in FIG. 3 as secondary brake mechanism 34. Secondary brake mechanism 34 is capable of selective actuation, is air cooled and operates on centrifugal force principles.

Figure 5:
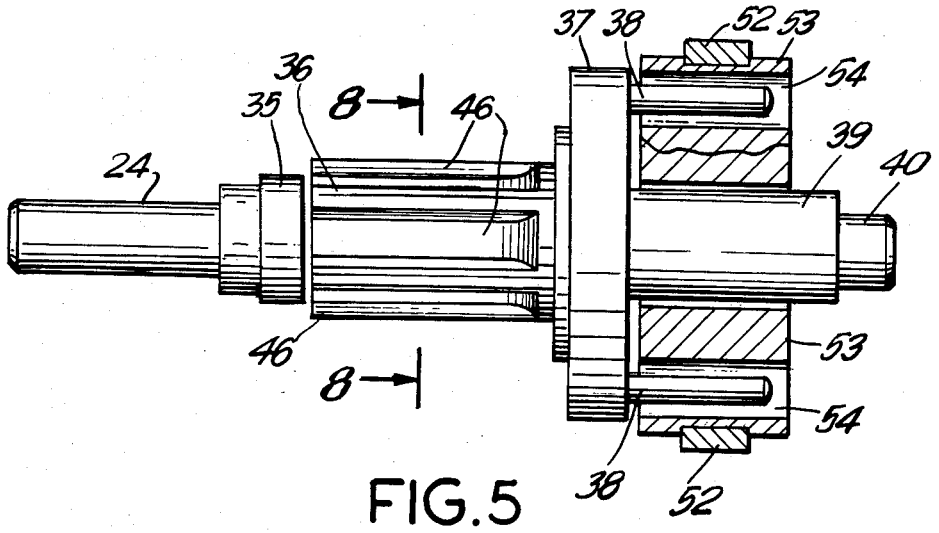
FIG. 5 is an isolated partial elevational view of some of the components of the brake mechanism as depicted in FIG. 4.

As illustrated in FIG. 5, axle 24 has mounted thereon gear member 23 as hereinabove set forth. Additionally, mounted upon axle 24 is guide member 35, guide member 35 assisting in accomplishing a structural mechanical interfit between axle 24 and alignment member 36 as hereinafter described. Alignment member 36 is structurally affixed to fly wheel 37 that has bar members 38 structurally affixed thereto and protruding perpendicular therefrom as illustrated in FIG. 5. Shaft member 39 is structurally mounted about axle 40, axle 40 and shaft member 39 being structurally affixed to fly wheel 37. As illustrated in FIG. 5, alignment member 36, fly wheel 37, shaft member 39 and axle 40 are assembled to provide one integrated element within the structure of secondary brake mechanism 34 that is capable of rotational movement about a common axis, said axis being aligned with the axis of axle 24. Furthermore, axle 40 and shaft 39 are structurally mounted within housing 11 of portable escape device 10 in a manner well known in the prior art so as to provide for stabilized rotational movement thereof.

In FIGS. 3, 4, 5 and 6 there is depicted the mechanical means by which secondary brake mechanism 34 is capable of being selective actuated for the mechanical engagement thereof. More particularly, as illustrated in said figures, actuation lever 41 is structurally mounted to housing 11 and due to the compression of spring 42 as illustrated in FIG. 3, actuation lever 41 has its pin member 43 forced against meshing member 44, meshing member 44 being circular in construction, having an indent portion 45 and having a center opening structured so as to form a compatible interfit with raised track members 46 of alignment member 36 such that meshing member 44 is capable of selective lateral movement parallel to the axis of alignment member 36 while being capable of being in mechanical interfit with alignment member 36 such that any rotational movement imparted to meshing member 44 is directly imparted to alignment member 36 and thus fly wheel 37, shaft member 39 and axle 40.

Figure 6:
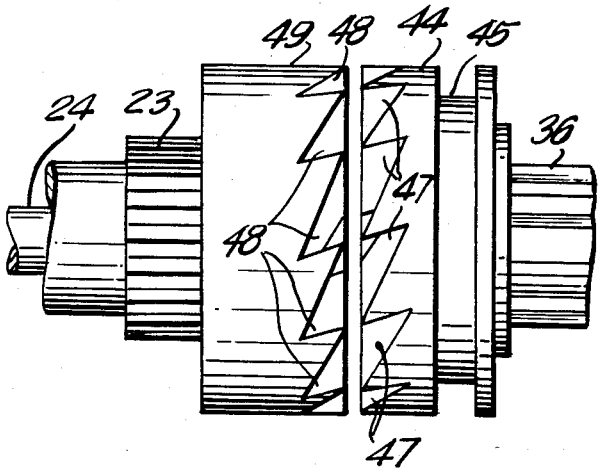
FIG. 6 is an isolated partial elevational view of some components of the brake mechanism as depicted in FIG. 4.
Figure 8:
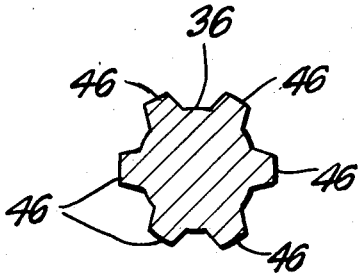
FIG. 8 is a cross sectional view of a component of the brake mechanism as illustrated in FIG. 5 and taken along lines 8—8.

In conjunction with the above, and as illustrated in FIG. 6, meshing member 44 has formed within its face portion indents 47 which are mechanically alignable with and selectably interfitable with indents 48 of coupling member 49. Coupling member 49 is structurally affixed to axle 24 and gear 23, axially aligned therewith and rotates about said common axis as a result of any rotational force imparted by gear member 23 to axle 24.

Figure 4:
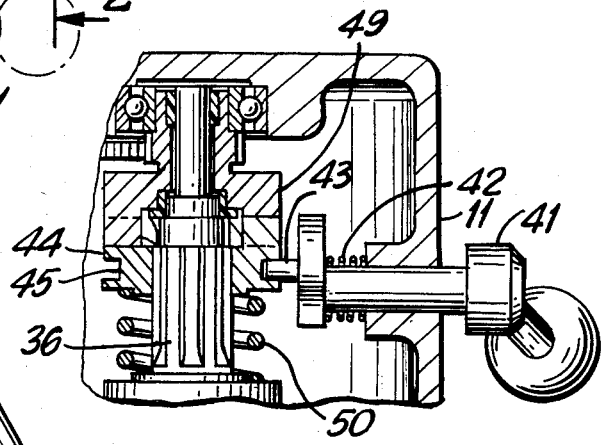
FIG. 4 is an isolated view of a portion of the cross-sectional view of one of the brake mechanisms depicted in FIG. 3.

In operation, and as illustrated in FIGS. 3, 5 and 6, when cable 16 is being fed out from portable escape device 10, due to the mechanical interrelationship between axle 15 and gear members 19, 20, 22 and 23, as well as axle 24, coupling member 49 is caused to rotate. By the actuation of actuation lever 41, meshing member 44 is caused to mechanically move parallel to the axis of alignment member 36 causing indents 47 of meshing member 44 to mechanically interlock with indents 48 of coupling member 49 thus engaging secondary brake mechanism 34. In FIG. 4 there is illustrated the engagement of meshing member 44 with coupling member 49 in accordance with the above. Additionally, as illustrated in FIGS. 3 and 4, spring means 50 is structurally positioned about alignment member 36 so as to apply a constant force independent of actuation lever 41 whereby meshing member 44 is caused to remain in mechanical contact with coupling member 49 once so engaged.

Figure 7:
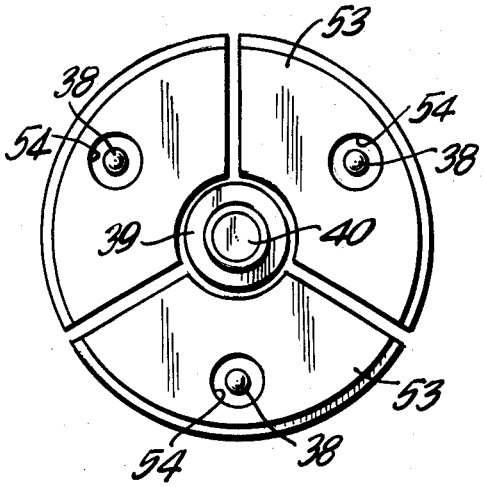
FIG. 7 is a side elevational view of the components of the brake mechanism as depicted in FIG. 6.

The braking means by which secondary brake mechanism 34 functions is illustrated in FIGS. 3, 5 and 7. In FIG. 3, brake housing 51 is structurally affixed to housing 11 of portable escape device 10. Brake shoe members 52 are structurally affixed to centrifugal brake members 53. Formed within each of centrifugal brake members 53 are cavities 54 which have positioned therein bar members 38. Centrifugal brake members 53 are wedge shaped as depicted in FIG. 7 and are contained within the confines of a cavity defined by brake housing 51 as to the bottom and circular side wall thereof and as to its top by fly wheel 37. By this configuration, centrifugal brake members 54 are capable of being rotated about the axis of shaft member 39 upon the rotational movement of fly wheel 37, alignment member 36 and meshing member 44 as hereinabove described upon the engagement of meshing member 44 with coupling member 49. Due to the positioning of bar members 38 within cavities 54, there is created a mechanical means whereby the rotational movement of fly wheel 37 causes the rotational movement of centrifugal brake members 53 within the confines of braking housing 51. As centrifugal brake members 53 are caused to rotate about the axis of shaft member 39, centrifugal brake members 53 are forced outward from the axis of shaft member 39 due to centrifugal force, the faster the rotational movement of centrifugal brake members 53, the greater the force applied. This centrifugal force is translated into having brake shoe members 52 frictionally contact brake housing 51 and due to friction, cause a braking affect to occur. In this manner there is achieved a second braking means to occur with regard to the operation of portable escape device 10. Additionally, the spacing between bar members 38 and the walls of centrifugal brake members 53 defining cavity 54 is sufficient to allow for sufficient movement of centrifugal brake members 53 away from the axis of shaft member 39 so as to enable frictional contact to occur between brake shoe members 52 and brake housing 51. Similarly, as the spinning of shaft member 39, fly wheel 37, alignment member 36, etc., and thus the release of cable 16 from portable escape device 10 is reduced or stops, similarly, and in direct correlation thereto, the centrifugal force causing the centrifugal movement of centrifugal brake members 53 lessens or in fact ceases thus enabling the pressing of brake shoes 52 up against brake housing 51 to lessen or cease. In this fashion, there is achieved a breaking force that is generated as related to the operation of portable escape device 10 that is directly correlated to the rate of release of cable 16.

In accordance with the above, and in keeping with the invention, the operation of portable escape device 10 and utilization as set forth in this preferred embodiment is as follows. Initially, portable escape device 10 has its housing 11 affixed to the interior structure of a building and cable 16 has one of its ends exposed through channel member 17, the remainder of cable 16 being wound internally within portable escape device 10 about drum 14.

Upon utilizing the device, an individual would fasten the exposed end of cable 16 about oneself in a fashion sufficient to physically contain said individual about said cable 16, it being envisioned to have cable 16 pass under the armpits of an individual and a loop thus created, the loose end of said cable being tied about itself to create a stable loop arrangement about the individual who is to be lowered in accordance with the invention.

Braking mechanisms 25 and 34 are engaged by actuation of lever 31 through the pulling of cable ring 56 and and thus cable 55 and actuation of actuation lever 41 respectively. Cable 16 is then drawn out of portable escape device 10 in an amount sufficient to permit the individual to crawl out of the window or other opening within the structure in question said individual to thus be lowered through the gravitational pull upon portable escape device 10 as a result of the weight of the individual as the individual is lowered by the device to the ground.

As the gravitational pull occurs, drum 14 axially rotates about axle 15 causing rotational movement of gear member 19 which in turn rotates gear member 20 which is physically affixed about axle 21, rotational movement of axle 21 thus causing rotational movement of gear 22 which in turn is intermeshed with gear 23 which is thus caused to rotate and thus causes rotational movement of axle 24, the rotational movement of axle 15 being mechanically controlled by brake mechanism 25 and the rotational movement of axle 24 being mechanically controlled by secondary brake mechanism 34. Thus, brake mechanism 25 and secondary brake mechanism 34 control the rate of release of cable 16 from drum 14 of portable escape device 10 and thus there is controlled the rate of descent of an individual utilizing the device in question, such control being necessary so as to provide the safe descent of such an individual.

In keeping with the invention, it should be noted that instead of having portable escape device 10 physically mounted upon a structure and thus have the end of cable 16 affixed to the individual, the reverse can occur, namely, that the exposed end of cable 16 can be affixed to some structural portion of a building and portable escape device 10 can be physically affixed to the individual themselves through the use of some harness or belt arrangement and thus as the individual descends in the manner described above, he descends with the portable escape device 10 in physical contact with said individual's person, and in this fashion, as described above, there is provided the ability for an individual to stop his descent prior to reaching the ground level should same be desired, or in the alternative, provide an individual the ability to override the preset brake tension through use of cable ring 56 during the rate of descent.

Additionally, it should be noted that secondary brake mechanism 34 is positioned within housing 11 of portable escape device 10 such that there is structurally created about secondary brake mechanism 34 cooling cavity 57 which sets forth a ray arrangement emanating from secondary brake mechanism 34 thus creating a unique and novel cooling chamber capable of cooling secondary brake mechanism 34 during its braking process in conjunction with the operation of portable escape device 10, said ray design providing a maximum of cooling capability within a limited and confined spatial arrangement by creating an extensive surface area over which heat can be dissipated.

It is further keeping with the invention that upon utilization of portable escape device 10, cable 16 can either be rewound manually back about drum 14 by use of crank mechanism 18, or in the alternative, as is well known within the prior art, by use of an electro-mechanical mechanism capable of interfit with axle 15.

Furthermore, upon utilization of portable escape device 10, it is within the scope of this invention that although a primary use of same is envisioned as a means to escape from a fire or the like within a building structure, it is also envisioned that same can be used in conjunction with police, para-military, military or construction activities wherein one seeks to be lowered from one location to that of another and/or lowered to a particular location and once at that particular location, to have said individual be able to lower himself further depending upon circumstances. The above is achieved by the fact that such use would incorporate having portable escape device 10 strapped about the individual himself with the loose end of cable 16 affixed about some permanent structure wherein said individual could, by utilization of crank mechanism 18, or by release of lever 31 associated with brake mechanism 25, said individual could selectively control his lowering from one position to that of another without having to descend fully to the bottom of the descent in question.

The preceding description and accompanying drawings relate primarily to a specific embodiment of the invention, and the invention in its broader aspect should not be so limited to one specific embodiment as herein shown and described, but departures may be made therefrom within the scope of the accompanying claims without departing from the principals of the invention and without sacrificing its chief advantages.

I claim:

1. A portable escape device capable of providing a means of safe descent from any tall structure, said devise comprising:

(a) a housing formed to define an internal cavity;

(b) a first axle structurally mounted for rotational movement within said internal cavity formed by said housing;

(c) a drum structurally mounted for rotational movement upon said first axle;

(d) a cable having one end thereof structurally affixed to said drum and the remainder of said cable then wound about said drum with the unaffixed end of said cable protruding outside said housing of said device, said cable being capable of being unwound from about said drum and in so doing, causing said drum and said first axles to rotate about their axes;

(e) a gear train array wherein a first gear of said gear train array is structurally axially affixed for rotational movement about said first axle and a second gear of said gear train array is structurally axially affixed for rotational movement about a second axle, said gear train array being such that the rotational movement of said first axle about its axis is imparted as rotational movement to said second axle;

(f) a first braking mechanism selectively actuated for controlling the rotational movement of said first axle, said drum structurally mounted for rotational movement about said first axle and thus the releasing from said device of said cable; and (g) a second braking mechanism selectively actuated for controlling rotational movement of said second axle and thus through the mechanical interrelationship of said second axle by way of said gear train array with said first axle and said drum structurally mounted for rotational movement about said fixed axle, there is achieved additional selective braking, said second braking mechanism comprising;

i. A coupling member axially mounted for symmetrical rotational movement about said second axle, said coupling member having formed about its exposed facial surface that is perpendicular to its axis of rotational movement indents symmetrically positioned about its circumference;

ii. A meshing member axially aligned with said second axle and said coupling member, said meshing member having formed about its exposed facial surface that is perpendicular to its axis of rotational movement and which is immediately adjacent to said coupling member indents symmetrically positioned about the circumference of said meshing member, such that the indents of said meshing member mechanically interfit with the indents of said coupling member upon the selective mechanical positioning of said meshing member into contact with said coupling member;

iii. Alignment member axially positioned along the axis of said meshing member, said alignment member having symmetrically positioned about its surface raised track member, said alignment member with its raised track members being in mechanical interfit with said meshing member such that said meshing member is capable of selective movement parallel to the axis of said alignment member while due to said mechanical interfit with said alignment member rotational movement of said meshing member will in fact impart rotational movement to said alignment member;

iv. A fly wheel axially aligned and structurally affixed to said alignment member;

v. Bar members symmetrically positioned about said fly wheel and protruding outward parallel to the rotational axis of said fly wheel from the surface of said fly wheel facing opposite to that of said alignment member;

vi. A brake housing structurally mounted within said housing of said escape device axially aligned with said fly wheel;

vii. Brake members symmetrically positioned within said brake housing in mechanical interfit with said bar members such that upon rotational movement of said fly wheel about its axis said brake members are caused to axially rotate within said brake housing and through centrifugal force said brake members are caused to come into mechanical contact with said brake housing thereby initiating frictional contact there between and thus achieve a means of braking as related to said portable escape device; and viii. An actuation lever structurally mounted through the wall of said housing such that the interior portion of said actuation lever is in mechanical interfit with said meshing member while the exterior portion of said actuation lever is capable of being actuated by a party utilizing said portable escape device, said actuation lever being such as to be capable of causing the selected movement of said meshing member parallel to the axis of said meshing member so as to cause the selected engagment or disengagement of said meshing member with said coupling member through the structural interfit or disengagement of the indents associated with said couplng member and said meshing member.

2. A portable escape device capable of providing a means of safe descent from any tall structure as defined in claim 1, wherein said gear train array comprises four gears, said first gear being structurally axially affixed for rotational movement about said first axle, said second gear being structurally axially affixed for rotational movement about said second axle and said third gear and said fourth gear of said gear train array being structurally axially affixed for rotational movement about a third axle structurally mounted for rotational movement within said internal cavity formed by said housing, said third gear and said fourth gear of said gear train array being intermediately positioned within said gear train array such that said third gear is in mechanical interfit with said first gear and said fourth gear is in mechanical interfit with said second gear.

3. A portable escape device capable of providing a means of safe descent from any tall structure as defined in claim 1, wherein said gear train array imparts to said second axle a rate of rotational movement greater than the rate of rotational movement of said first axle.

4. A portable escape device capable of providing a means of safe descent from any tall structure as defined in claim 1, wherein said second braking mechanism is air cooled by having the housing of said portable escape device occurring at the location of said second braking mechanism define a corrugated ray arrangement emanating from said secondary brake mechanism, said corrugated ray arrangement providing a maximum surface area within a confined spatial arrangement over which heat can be dissipated.

5. A portable escape device capable of providing a means of safe descent from any tall structure as defined in claim 1, wherein said drum is capable of being manually rotated thus enabling said cable to be rewound about said drum.

6. A portable escape device capable of providing a means of safe descent from any tall structure as defined in claim 1, wherein said drum is capable of being rotated by automatic mechanical means thus enabling said cable to be rewound about said drum.

7. A portable escape device capable of providing a means of safe descent from any tall structure as defined in claim 1, wherein said portable escape device is capable of being structurally mounted to a structure by use of fastening means that pass through openings formed within said housing of said portable escape device and which are structurally anchored to said structure.

8. A portable escape device capable of providing a means of safe descent from any tall structure as defined in claim 1, wherein said portable escape device is capable of being harnessed to an individual and thus carried upon the person of an individual utilizing said portable escape device as said individual descends a particular structure.

* * * * *